US005500706A

United States Patent [19]

Ramos

[11] Patent Number: 5,500,706

[45] Date of Patent: Mar. 19, 1996

[54] DEVELOPING PROCEDURE AND MACHINE TO CARRY OUT THE PROCEDURE

[75] Inventor: Gregorio F. Ramos, Vitoria-Gasteiz, Spain

[73] Assignee: F.M. Control, S.L., Victoria-Gasteiz, Spain

[21] Appl. No.: 317,562

[22] Filed: Oct. 4, 1994

[30] Foreign Application Priority Data

Oct. 6, 1993 [ES] Spain ..... 9302091

[51] Int. Cl.[6] ..... G03D 3/02

[52] U.S. Cl. ..... 354/326; 354/328; 354/331

[58] Field of Search ..... 354/319–324, 354/327, 330, 337, 310–313; 134/120, 64 R, 64 P, 122 R, 122 P

[56] References Cited

U.S. PATENT DOCUMENTS

| | | | |
|---|---|---|---|
| 3,668,997 | 6/1972 | Ratowsky | 354/323 |
| 4,198,153 | 4/1980 | Hamlin | 354/327 X |
| 4,890,131 | 12/1989 | Kuzyk et al. | 354/330 X |
| 5,257,059 | 10/1993 | Ramos | 354/331 X |

FOREIGN PATENT DOCUMENTS

| | | | |
|---|---|---|---|
| 211251 | 6/1909 | Germany . | |
| 571559 | 3/1933 | Germany . | |
| 2459858 | 6/1976 | Germany . | |
| 26194 | of 1911 | United Kingdom | 354/310 |
| 2122921 | 1/1984 | United Kingdom | 354/324 |

*Primary Examiner*—D. Rutledge
*Attorney, Agent, or Firm*—Browdy and Neimark

[57] ABSTRACT

A developing procedure and a machine to carry out this procedure, based on a cylindrical tank with a horizontal shaft, which, by means of a motor with a double turning direction, moves an carrier arm that pulls a material holder with the material to be developed. The material holder passes through the bottom or base of the tank, in which the developing liquid is placed, turning alternately in each direction. The developing liquid is extracted and the tank is filled with another liquid, until a specific developing process is completed. The unit is contemplated with a microprocessor control, thus forming a simple, portable machine at a low cost.

8 Claims, 1 Drawing Sheet

DEVELOPING PROCEDURE AND MACHINE TO CARRY OUT THE PROCEDURE

FIELD OF THE INVENTION

This relates to a developing procedure and a machine to perform this procedure, which is applicable to photographs and slides.

DESCRIPTION OF THE PRIOR ART

Insofar as is known, there are developing machines on the market, for instance made by the German firm JOBO, which use a series of hollow cylindrical tanks, in whose interior the negatives to be developed are placed arranged in rolls. In successive operations, a developing liquid enters inside the tank in which the material to be developed has been arranged, and performs its function. Once that a liquid has finished its cycle, the tank is tilted over so that the liquid runs out and then returns to the previous position so as to receive a new liquid.

The disadvantage of these machines is their great complexity and their physical size. Apart from this, the speed at which they work is relatively slow.

Also known, through the Spanish patent P. 8702521 in favour of the applicant, is a processor which uses a special helicoidal tank made up of independent chambers. A material-holder arm, which includes a special element that receives the material to be developed, travels through the tanks. This arm and material-holder are the objects of Spanish patent application P. 9100780, also in favour of the applicant.

Although this developing machine has improved features in relation to the earlier technique, it is a machine of a considerable price and quite bulky in size.

SUMMARY OF THE INVENTION

One object of the invention is a procedure which speeds up the execution of the operations, all within a small space in the machine in question.

In order to carry out these objectives, the invention relates to a working method based on an arm which turns alternately in one direction or the other, with a material-holder being fitted to the end of this arm, and the material to be developed placed on board this material-holder. This material-holder, which is of the type described in the above-mentioned Spanish patent application P. 9100780, takes up a very small space and allows a considerable amount of material to be stored.

The centre of the oscillating arm is in turn the centre of a tank in the shape of an upwardly concave circular segment below the said centre. This tank receives a certain amount of a specific developing liquid and, with the liquid in the said cavity, the arm is made to turn alternately in one direction and the other, so that during these movements the material to be developed is in contact with the developing liquid in question.

After a time, the liquid in question is extracted from the tank and replaced by another complementary liquid in the developing process, after which the turning of the arm is restarted and the material is passed through this second liquid. Through successive operations of this kind, the material to be developed is passed through all the different liquids until the cycle is completed. When the cycle terminates, the photographic material is ready.

The simplicity of this procedure lies in the fact that there is only one single cavity or chamber for the different liquids and only one type of movement, which is always the same, for the material to be developed.

The different liquids are fed into the tank through flexible pipes from their individual storage tanks. Suitable pumps, duly programmed, are used to carry the liquids to the tank, and to extract each liquid, once it has been used, there is one single pump at the bottom of the tank, connected to a flexible pipe, making it easy to extract the liquids to wherever desired.

The arm which causes the material-holder to oscillate is connected to a shaft, which in turn is driven by a motor that turns in both directions and is connected to a power supply.

The entering into operation of the pumps for the different liquids, the extractor pump at the bottom of the tank and the two-directional motor that drives the arm are all controlled by a programmer device based on an electronic circuit operated by external controls, which can even set the time of each cycle.

The machine to perform this kind of developing work consists of a frame with a rectangular cross section, with a base in which the storage tanks for the developing liquids are situated and with a lower front portion for locating the electronic programmer unit mentioned above.

An internal frame is housed in the cavity formed on the said base of the machine, with this internal frame taking in the mechanism of the invention. The cavity in question is provided with a base or bottom and upward walls that finish at the edge of the device.

The frame is composed of two parallel rectangular plates connected to each other by means of cross members, with these plates being fitted to the longer walls of the cavity in the machine.

Both plates are solidly fixed to each other by means of another plate of a partially cylindrical shape which, on the one hand, keeps the two longer plates parallel and, on the other, constitutes an open downward cavity which forms the tank into which the developing liquids will be fed. The lower base or bottom of this plate or tank remains a certain distance from the lower edge of the two parallel plates, while the upper part is open at the top to allow the user to have access to the developing machine through this area.

The two plates are each provided with horizontally aligned central cut-outs, between which is housed a shaft surrounded by a ring gear, which in turn is the theoretical centre of the tank.

The shaft is connected to a material-holder arm, which is fixed to it and whose radius on turning is approximately the same as the dimension of the tank. Close to the end of this arm is situated one wing of an L-shaped part, with the flexible material-holder being secured to the other wing. In this way, when the arm turns, the material-holder travels along the bottom of the tank.

Inside one of the two plates, a two-directional electric motor is fastened, with a pinion attached to the shaft take-off. This pinion engages with the ring gear on the centre shaft, so that when the motor is working, the shaft, together with the arm and the material-holder, turns alternately in one direction and the other inside the tank.

The lowest portion of the tank is provided with a hole in which a pump is situated, responsible for extracting the different liquids contained in the tank.

Above the tank and a certain distance from the bottom of it, another plate is arranged, in the shape of a circular segment, which is concentric with the tank. This segment is taken in between two parallel horizontal shafts, which keep it in position and also act as a reinforcement for the two parallel plates. The lowest portion of this segment receives a level probe, whose characteristics will be described later.

Also arranged between the two parallel longer plates is a cross support for the pipes of the different developing liquids. A set of holes is cut in this support, through which the said flexible pipes pass, with their free ends reaching the proximity of the bottom of the tank, while each of them is connected to the corresponding storage tank for each of the liquids in question.

During operation, the material-holder arm carries out the alternate movement mentioned above, so that the material-holder passes through the bottom of the tank, where there is a certain liquid. The area which is concentric with the tank and in which the probe is situated does not cause any hindrance to this passage, since the angle at which the arm moves is not so great that it can make contact with the said concentric area where the probe is. On the contrary, the material-holder can travel through the space between the base area of the probe and the bottom of the tank, so that all the material to be developed is bathed by the liquids.

The bottom of the appliance, in which the two parallel plates are housed, receives hot water up to a preset level, in order to heat the liquids contained in the tank, with the water level reaching a certain height on the outside of the tank in order to procure this heating.

BRIEF DESCRIPTION OF THE DRAWINGS

The accompanying sheet of drawings shows a non-restrictive solution of the invention, in which the following are represented.

DESCRIPTION OF THE PREFERRED EMBODIMENTS

Figure 1:
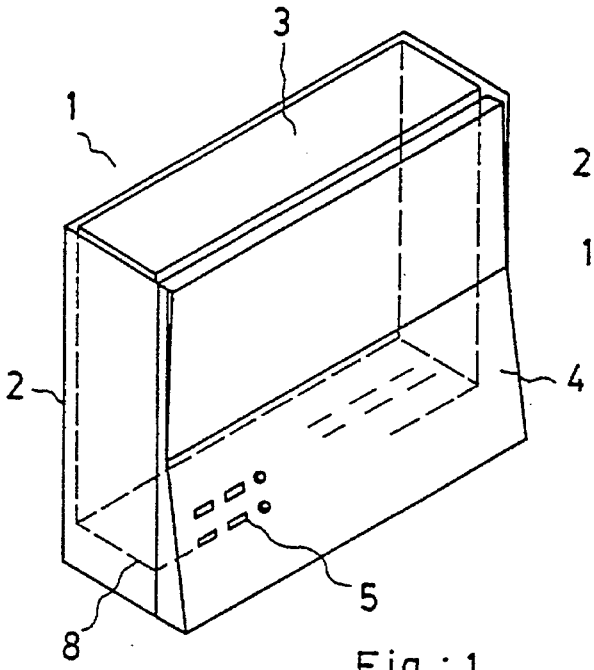
FIG. 1 is a perspective of the general frame of the machine which is the object of the invention.

Looking now at FIG. 1, we can observe the whole of the developing machine (1), which has an interior cavity with its longer sides (3), shorter sides (2) and a base (8), below which the necessary items for the mechanisms can be provided. This unit is closed at the sides and open at the top so as to allow the user access to its interior. This top is fitted with a withdrawable closing lid, which is not shown here.

The front part of the machine (4) receives an electronic unit (5), by means of which all the variables of the machine are maintained and controlled, such as the intake of developing liquid, the turning time of the arm in alternate directions, the stopping of turning, the extraction of developing liquid, the temperature of liquids, etc. A conventional circuit, such as a programmed microprocessor, designed for the purpose could perfectly carry out all these controls, sending the appropriate signals and receiving the necessary responses in order to programme a specific task.

Figure 2:
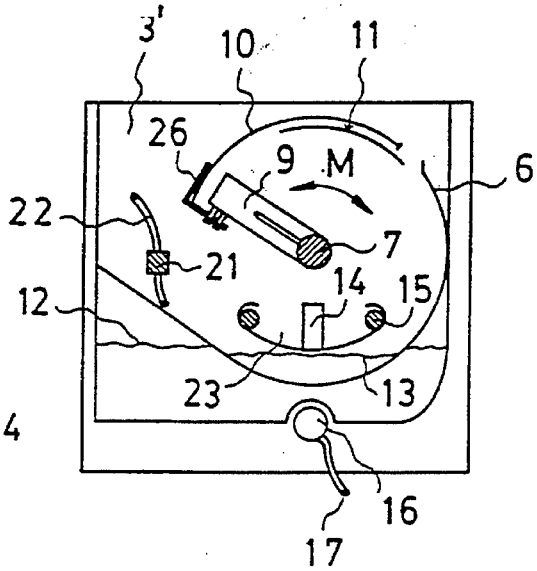
FIG. 2 is an elevation which shows the parallel plates and other mechanisms of the machine.

FIG. 2 shows one of the two parallel plates (3', 3") which are secured together at a suitable distance and will occupy the cavity provided by the machine, both in height and in width. Both plates are connected to each other by the cylindrically shaped plate forming a tough-like tank (6), in which the different liquids will be held. As can be seen, this tank (6) leaves the upper part of the the plates free in order to allow handling.

Between both plates, the centre shaft (7) can be observed, connected to the carrier arm (9), which in turn and by means of a part (26) receives the material-holder (10). In the same way, between the plates, the support part (21) is arranged for the flexible pipes (22), through which the different liquids are fed into the bottom of the tank, and below the shaft (7) is the base (23) concentric with the tank (6) and secured to two shafts (15), in the centre of which, through a hole, a sensor or probe for the level of the liquid in the tank is located.

The lower portion of the tank (6) is occupied by a motor-driven pump (16), which is responsible for extracting each kind of liquid from the bottom of the tank, once the material to be developed has been dipped in it for the time required. This pump (16) is connected to an outlet pipe (17), through which the liquids are extracted.

The bottom of the machine is occupied by hot water, up to a certain level (12), for example, so that it surrounds the exterior of the tank (6), occupied on the interior by a developing liquid up to the level (13). As can be seen in FIG. 2, the water container under the tank (6) is generally rectangular in cross section, and has a rectangular prismatic shape.

Jutting out on the upper part of the plate is a projection (11) which is concentric with the tank (6) and is secured to the interior of one of the plates in order to act as a guide for the material-holder (10) in the free upper area of both plates. This projection is of a substantially narrower width than the distance between the plates.

Figure 3:
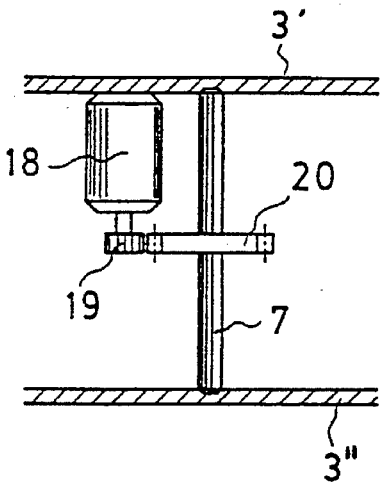
FIG. 3 is a top view of the assembly of the two parallel plates, showing the shaft and the motor, on a larger scale.

As shown in FIG. 3, we can see the arrangement of the shaft (7) between two plates (3') and (3"), with the shaft having a ring gear (20) engaged with a pinion (19) fitted at the end of the shaft outlet of the two-direction motor. This motor is secured by conventional means to the plate (3') in such a position that it does not hinder or impede the turning of the carrier arm (9)in an alternate movement, as illustrated by (M).

Figure 4:
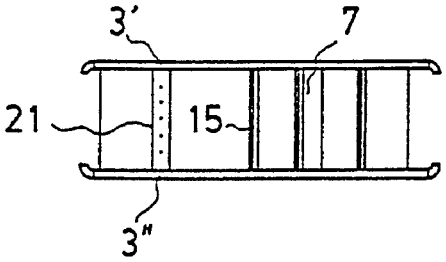
FIG. 4 is a top view of the whole of the two parallel plates.

In FIG. 4 we can see the two plates (3') and (3") and how they are connected by the shaft (7) and the lower shafts (15) that support the base (23) of the probe (14), as well as the support part (21) for the flexible pipes (22), with the plates at the same time being connected to each other by means of the tank itself. In this drawing, to make its interpretation clearer, neither the probe (14) nor the motor (18) have been included.

The support part (21) for the flexible pipes (22) is provided with a set of through holes, into which the pipes in question are situated. Each one of these is connected at one end to a storage tank of developing liquid, while the other free end of each extends towards the bottom of the tank (6).

Figure 5:
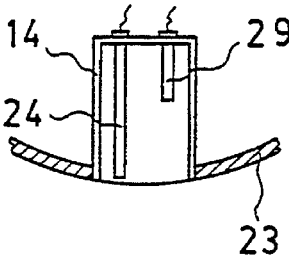
FIG. 5 is a detail of the probe and of its positioning.
Figure 6:
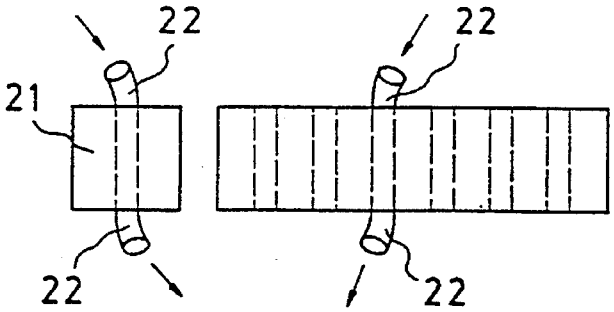
FIG. 6 illustrates two side views of the part which supports the flexible pipes through which the developing liquids are fed into the tank.

The probe (14) is illustrated in FIG. 5, positioned over a hole in the base of the plate (23), and capable of detecting two different levels by means of its two height sensors, for maximum (25) and minimum (24), for example, indicating the limits between which the material to be developed can be dipped into the liquid without any problems.

Figure 7:
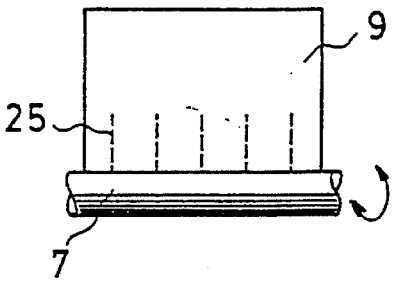
FIG. 7 is a detail of the connection of the shaft to the base to which the material-holder is secured.

The shaft (7) is illustrated in FIG. 7, connected to the carrier arm (9) by means of the appropriate fixing elements (29) so that the said carrier arm rotates with the shaft in question. This illustration does not show the fixing elements for the part (26) which connects the material-holder (10), which are secured in the conventional way.

The method of operation of the invention is most simple, and begins with situating the machine close to a source of water, such as a the tap of a washbasin, a kitchen sink, etc., since one of the features of the invention is the fact of its being independent and portable due to the reduced space which it occupies.

Once the machine has been connected to the water supply and the developing liquid storage tanks have been connected to their flexible pipes (22), the electronic circuit can be programmed in terms of the material to be dealt with, setting the times, intakes, etc. on the front panel (5). After this, the material holder (10) with the photographic material to be developed is attached to the part (26).

Firstly, water is taken into the base or bottom (8) of the machine until it reaches the desired level, with the rest running out through an overflow. This water is then heated by means of heating elements in the machine itself.

The intake of the first developing liquid takes place towards the interior of the tank through one of the flexible pipes (22) until a certain level, controlled by the probe (14), is reached. Once it is at the correct level and temperature, the motor (18) begins to operate, causing the rotation in alternate directions of the shaft (7).

During the time set, the arm rotates in both directions, so that the material to be developed passes through the lower part of the tank and through the developing liquid at all times, with the said developing liquid performing its effect on the photographic material.

When the time set finalizes, the arm stops and the pump (16) begins to operate, extracting the first liquid from the tank, to be followed immediately by the second liquid being fed into the tank (6) and the initiation of the second cycle, and so on until the developing process is completed.

The small space occupied by this developing machine and the speed at which it works make this unit an essential tool in certain fields of the activity, for press photographers, for example, or for amateur photographers, who can develop their photographs at slides with a low cost machine.

It is important to point out, once having described the nature and advantages of this invention, the non-restrictive character of the same, inasmuch as changes in the shape, material or sizes of its constituent parts will not in any way alter its essentiality, as long as they do not mean a substantial variation of the whole.

I claim:

1. A developing procedure, of the type in which material to be developed is housed in an interior of a liquid vessel, into which a first liquid is introduced so that the material can be immersed in the first liquid for a certain time, with the vessel then being emptied after the certain time, followed by introduction and later draining of a second liquid, so that total developing of the material can be thus carried out in successive operations, the procedure comprising:

arranging the material to be developed on an end of a material holder secured to an end of a carrier arm connected to a shaft which can rotate alternately in one direction and an other direction, with the material holder having appropriate guides;

feeding developing liquid into a bottom of an interior of a fixed tank which is approximately cylindrical in shape and whose centre coincides with that of the shaft of the two-directional carrier arm, with the shaft being horizontal and the tank being kept at a suitable temperature;

making the material holder with the material turn alternately in the one direction and the other direction, so that for a period of time the material passes through the first liquid;

extracting or draining the first liquid from the tank and feeding the second liquid into the bottom of the tank, making the material holder and the material pass in the first direction and the second direction through the second liquid;

repeating cycles of feeding a developing liquid into the tank, alternate rotating of the material holder with the material to be developed through the developing liquid, and draining of the developing liquid, until the material is developed;

controlling a height of each developing liquid in a tank interior of the tank by means of a maximum-minimum probe.

2. The procedure, in accordance with claim 1, characterized in that the tank is housed in an interior of a container with water heated to an appropriate temperature, such that the different developing liquids are kept at the appropriate temperature.

3. The procedure, in accordance with claim 1, characterized in that while the developing liquid are being fed into the interior of the tank or drained out of it, the shaft and the carrier arm remain static.

4. The procedure, in accordance with claim 1, characterized in that an operation of intake of water, heating of the water, feeding and draining of developing liquids, control of the level probe, and turning of the shaft with the carrier arm are all programmed by means of a microprocessor.

5. A developing machine, comprising a container of a rectangular prismatic shape, having a bottom whose interior receives water, the container receiving interiorly a tank which is housed on walls of the container, the tank being cylindrical in shape and having a horizontal axis, and an opening at the top thereof to allow access to a tank interior; a shaft disposed through the centre of the tank; a ring gear operated by a pinion protruding from a two-directional motor secured to the tank interior; a longitudinal carrier arm secured to shaft and a material holder for the material to be developed secured to the carrier arm; a cross support part being disposed in the tank interior, with holes therethrough to hold flexible pipes connected to storage tanks to feed developing liquids into a tank bottom of the tank, the developing liquids being moved by pumps, such that the water level in a container bottom of the container surrounding a bottom exterior part of the tank in which the developing liquids are held; liquid levels being maintained and controlled by a probe housed in the tank and a pump for extracting or draining each developing liquid from the tank once it has been used.

6. The machine, in accordance with claim 5, wherein the tank is designed based on two parallel plates held in position against longer walls of the container, the plates being connected with an upwardly open cylindrically-shaped portion, as well as with the rotating shaft of the carrier arm, a holed cross support part and other cross reinforcing parts.

7. The machine, in accordance with claim 5, characterized in that the tank includes two interior cross arms disposed below the shaft and to both sides of it, which hold an arc-shaped plate, arranged above the cylindrical tank bottom; the plate having a hole in which a level probe is housed.

8. The machine, in accordance with claim 5, characterized in that close to the opening in the top of the tank, there is a projection in a form of an arc, of a certain width and with a theoretical center thereof coinciding with the shaft in the tank on which the material holder for the material to be developed travels.

* * * * *